United States Patent [19]

Tallody

[11] 4,319,100

[45] Mar. 9, 1982

[54] DUAL IN-LINE PROGRAMMING SLIDE SWITCH

[75] Inventor: Alexander Tallody, Highland Lakes, N.J.

[73] Assignee: AMF Incorporated, White Plains, N.J.

[21] Appl. No.: 159,337

[22] Filed: Jun. 13, 1980

[51] Int. Cl.[3] ..... H01H 15/00; H01H 1/18

[52] U.S. Cl. ..... 200/16 R; 200/16 D; 200/241; 200/153 LA; 200/6 B

[58] Field of Search ..... 200/16 R, 16 C, 16 D, 200/6 B, 6 BA, 6 BB, 153 LA, 67 G, 68, 76, 77, 78, 241

[56] References Cited

U.S. PATENT DOCUMENTS

| | | | |
|---|---|---|---|
| 2,762,880 | 9/1956 | Hathorn et al. | 200/16 D X |
| 2,966,560 | 12/1960 | Gluck | 200/16 C |
| 3,221,115 | 11/1965 | Feher, Jr. | 200/17 R |
| 3,249,725 | 5/1966 | Hutt et al. | 200/153 LA |
| 3,770,921 | 11/1973 | Wilbrecht | 200/16 R |
| 3,879,592 | 4/1975 | Comerford et al. | 200/241 X |
| 4,107,482 | 8/1978 | Marker | 200/6 B |
| 4,139,746 | 2/1979 | Farrell et al. | 200/16 D |

*Primary Examiner*—James R. Scott

*Attorney, Agent, or Firm*—George W. Price; Lawrence Hager

[57] ABSTRACT

A slide switch construction including two spaced-apart stationary contacts and a free-ended serpentine shaped leaf spring bridging contactor which undergoes both a rocking and sliding motion in making/breaking bridging contact across the stationary contacts. The slide actuator includes camming surfaces which in addition to urging the bridging contactor into the make/break position, coacts therewith to provide a detent holding of the switch in the "on" and "off" position.

9 Claims, 8 Drawing Figures

DUAL IN-LINE PROGRAMMING SLIDE SWITCH

FIELD OF INVENTION

This invention relates to electrical switch means and, in particular, to an electrical slide switch of improved construction and simplicity.

BACKGROUND OF THE INVENTION

Typically, a slide switch is characterized by a base defining at least two contacts and an assembly including a slider and a bridging contactor. When the assembly is attached to the base, the slider provides for sliding movement of the bridging contactor relevant to the spaced-apart contacts for changing switch positions.

BRIEF STATEMENT OF THE PRIOR ART

The prior art includes numerous slide switch designs which employ an assembly of two or more leaf spring members as the spring contact member such as shown in U.S. Pat. No. 3,461,252.

The prior art is also replete with attempts to obtain a snap action in the making and breaking of electrical contacts. One attempt, shown in U.S. Pat. No. 3,072,757, employs a single element spring contact member which is bowed outwardly at a central portion to provide a central protrusion that rides over the contact poles.

Another prior art patent of interest with regard to the present invention is U.S. Pat. No. 3,917,921. This reference describes a switch having a U-shaped actuator which fits over (cantilevered) lead contacts. One of the leads is L-shaped in a contact area, while the other is L-shaped with an S-shaped contact section. Actuation of the switch is achieved by interaction of a downwardly projecting actuating member formed on the slider which contacts the upward bend to force the downward bend into contact with the contact area when the switch is closed. Apparent shortcomings of this switch construction are that the surface between the contact areas do not undergo a sliding and, thereby, cleaning motion and that the leads must be formed from highly resilient material which increases manufacturing costs.

Other prior art patents of some interest include U.S. Pat. Nos. 3,221,115 issued Nov. 30, 1965 to Feher; 3,139,746 issued Feb. 13, 1979, to Farrell et al; 4,035,594 issued July 12, 1977, to McKinney; 3,719,788 issued Mar. 6, 1973, issued to Holland; 4,081,632 issued Mar. 28, 1978 to Schaffeler; 4,092,504 issued May 30, 1978, to Kotaka; 4,095,060 issued June 13, 1978, to Keprda; 2,762,880 issued Sept. 11, 1956, to Hathorn et al; 2,966,560 issued Dec. 27, 1960, to Gluck; and 3,072,757 issued Jan. 8, 1963 to Gluck.

These patents are mentioned as being representative of the prior art and other pertinent patents/references may exist. None of the above cited patents are deemed to affect the patentability of the present claimed invention.

In contrast to the prior art, the present invention provides a slide switch assembly which utilizes a free-ended serpentine shaped spring bridging contactor pivotally held approximately at its mid region which cooperates with a camming surface(s) on a slider to combine the advantages of both a sliding and rocking action in moving from one switch condition to the other, effects self-detenting of the bridging contact in the selected switch "on" and "off" position and involves a minimum of associated parts.

SUMMARY OF THE INVENTION

The invention comprises a slide switch construction which has particular utility for side-by-side slide switches housed in a dual in-line programming (DIP) switch package. The stationary contacts of each switch are flat and spaced across the bottom of the switch housing. The bridging contactor comprises a serpentine shaped leaf spring which is pivotally or rotatably held approximately at its mid region. Two upper curved (apex) portions of the bridging contactor cooperate with a camming element(s) on a slide track actuator to cause the bridging contactor to undergo a compound motion, i.e. a pivoting and sliding motion, during the switch make/break transactional operation.

Detent means is defined by at least one upper curved portion of the bridging contactor and by a camming element on the slide (track) actuator.

Accordingly, an object of the invention is to provide a new and improved slide switch.

It is a further object of the invention to provide a bridging contactor which combines the advantages of both a sliding and rocking action in moving from one switch condition to the other.

It is a further object of the invention to provide a new and improved bridging contactor having a serpentine shape.

It is a further object of the invention to provide a free-ended bridging contactor.

It is a further object of the invention to provide a new and improved bridging contactor which is pivotally held approximately at its mid region.

It is a further object of the invention to provide a free-ended serpentine shaped leaf spring bridging contactor pivotally held approximately at its mid region.

Another object of the invention is to provide a new and improved bridging contactor which cooperates with a slide (track) actuator to combine the features/advantages of both a sliding and rocking action in moving from one switch condition to the other, and effects self-detenting in at least one switch position.

Other objects and advantages will be apparent to those skilled in the art from the detailed description of the drawings.

BRIEF DESCRIPTION OF THE DRAWINGS

The accompanying drawings illustrate the preferred embodiments of the present invention by way of example. Like numerals refer to like parts throughout.

DETAILED DESCRIPTION OF THE INVENTION

Figure 1:
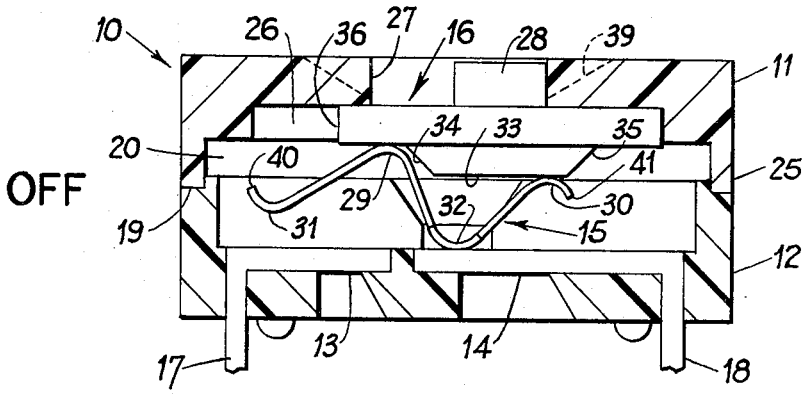
FIG. 1 is a cross-sectional side view of one switch section constructed in accordance with the invention with the contacts open.
Figure 2:
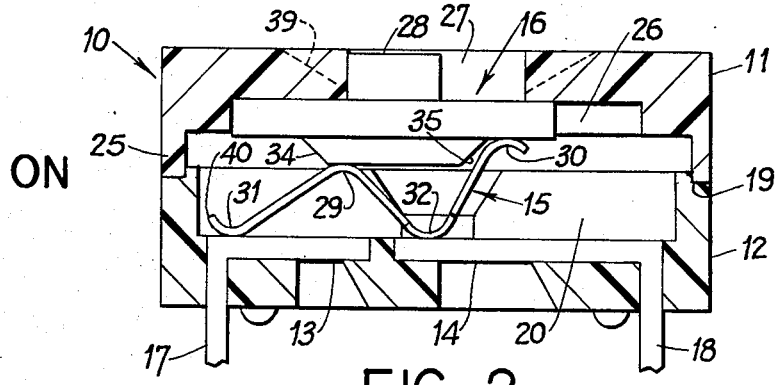
FIG. 2 is a cross-sectional side view of one switch section constructed in accordance with the invention with the contacts closed.
Figure 3:
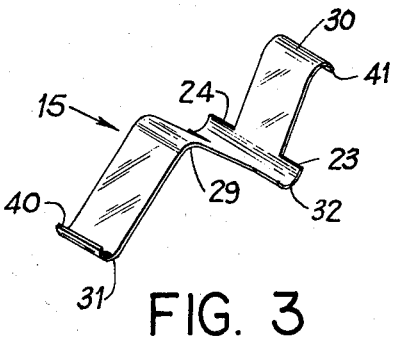
FIG. 3 is a top view of the bridging contactor constructed in accordance with the invention.
Figure 4:
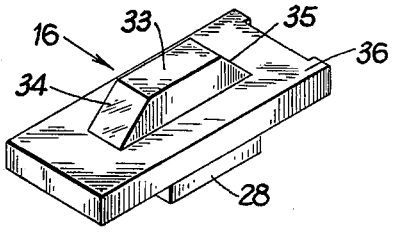
FIG. 4 is an upturned perspective view of the slider shown in FIGS. 1 and 2.

Referring to the drawings, particularly FIGS. 1 through 5, there is shown a slide switch 10 constructed in accordance with the invention to have a simple on-off action comprising a housing which includes a top cover 11 and a base member 12, two spaced apart flat stationary contacts 13 and 14 secured in the base member 12, a bridging contactor 15 having a serpentine or sinusoidal shape and a slider, or operating member, 16 disposed within the slide switch 10. The contacts 13, 14 have leadouts 17 and 18, respectively, projecting downwardly through the base member 12.

As noted above, the switch housing includes a top cover 11 and a base member 12. The housing may be formed of any suitable insulating material. The base member 12 includes a peripheral ledge 19 and a longitudinal cavity 20 extending from one end wall of the switch to the other. The cavity 20 is open at the top and has two intermediate slots 21 and 22 for accommodating the rocker arm means 23 and 24, respectively, of the bridging contactor 15. The top cover 11 includes downwardly projecting wall means 25 which is supportably mounted on the ledge 19 of the base portion 12, a recess or cavity 26 for receiving the slider 16 and an elongate aperture 27 to accommodate the slide head portion 28.

The bridging contactor 15 is formed from resilient sheet material, and has a serpentine configuration with at least two upper and two lower curved portions 29, 30 and 31, 32, respectively. The bridging contactor 15 is disposed within the longitudinal cavity 20 of the base member 12 to permit rocking or pivoting about the lower curved portion 32 while being maintained in electrical contact with switch (terminal) contact 14.

As noted above, the rocker or pivot arm means 23, 24 extend sidewards into a respective slot 21, 22, and are adapted to cooperate with the slots 21, 22 for defining the longitudinal position of the bridging contactor 15 within cavity 20. According to another feature of the invention, the pivot arm means 23 and 24 are contoured to cooperate with slots 21 and 22, respectively, to enable pivoting of the bridging contactor 15. The pivot arm means may also be adapted to permit sliding engagement between the lower curved portion 32 and contact 14 during the switch make/break operation.

Lower curved portion 31 is contoured to permit sliding engagement with contact 13 during the switch make/break operation.

The two upper curved (apex) portions 29, 30 are contoured and spaced-apart, at a distance approximately equal to or less than the length of the flat track portion 33 of slider 16, to cooperate with the slide camming surfaces 34, 35, respectively, to effect pivoting, compressing and detent holding of the bridging contactor 15 during switching "on" and "off" transaction.

The slider 16 is movable between the "off" position (shown in FIG. 1) and the "on" position (shown in FIG. 2) and includes an upwardly extending head portion or knob 28 protruding through the elongate aperture 27 in the top cover 11, and a flat track portion 33 having its ends forming inclined camming surfaces 34 and 35.

The base portion 36 of slider 16 overhangs cavity 20 and is in sliding engagement with the flat surface 37 of base member 12. The flat track portion 33 projects downwardly into the longitudinal cavity 20 and rides on the upper curved portions 29 and/or 30 of the bridging contactor 15.

Figure 5:
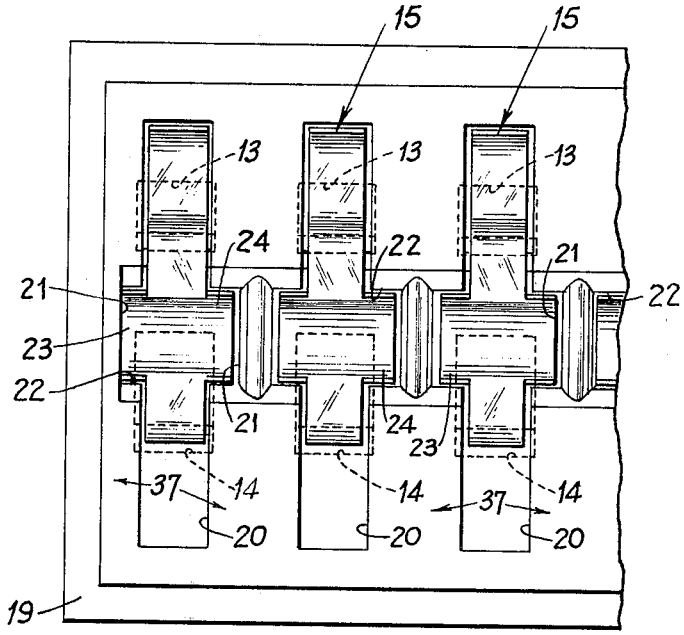
FIG. 5 is a partial top view of a housing having a plurality of side-by-side elongate cavities in a DIP switch package constructed in accordance with the invention with the top cover and slider assembly removed.
Figure 6:
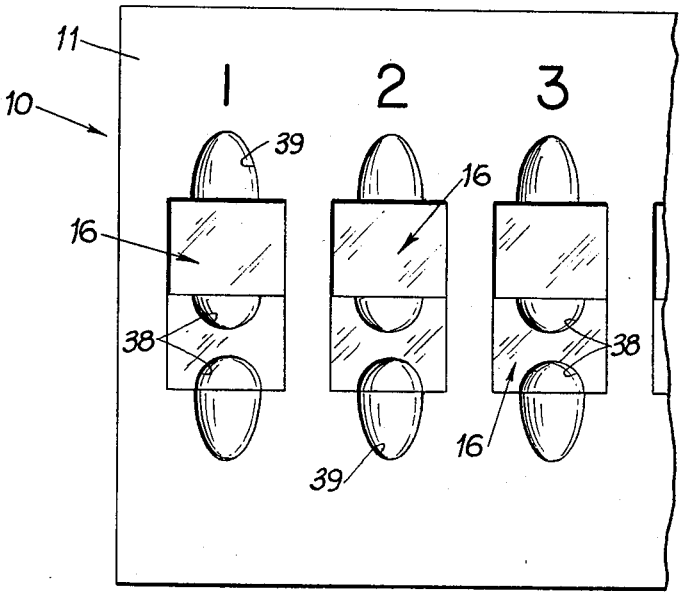
FIG. 6 is a partial top view of the DIP switch package shown in FIG. 5 with the top cover and slider utilized.

With reference to FIGS. 5 and 6, it can be seen that the invention has particular utility in applications where a plurality of slide switches are arranged side-by-side in a common housing to form a dual in-line programming (DIP) switch package. The stationary contacts 13 and 14 are shown in phantom outline. The slider head 28 and/or the elongate aperture 27 may contain bifucated cut-outs 38 and 39, to facilitate slider actuation with a small or pointed object.

OPERATION

As mentioned, the slider 16 is in the "off" position in FIG. 1, and when the projecting head portion 28 is subjected to an operating force directed from right to left in the Figure, the slider 16 moves to the left. As the slider 16 moves to the left, the (first) upper curved portion 29 abuts camming surface 34 which drives the (second) lower curved portion 31 in a downward direction. As the (first) upper curved portion 29 is cammed downward, the (second) lower curved portion 31 is forced into electrical contact with switch contact 13 and causes it to slide or wipe across contact 13 with outward bowing relative to the (first) lower curved portion 32.

Continued operating force on the slider 16 to the left will force the bridging contactor 15 into a fully compressed state (not shown) with both upper curved portions 29, 30 at or near an unstable (straddling) position between camming surfaces 34, 35 respectively, and the flat track portion 33. Further operating force on the slider 16 to the left results in the (second) upper curved portion 30 being cammed/biased in an upward direction resulting in a pivoting or rocking motion of the bridging contactor 15 about the lower curved portion 32 and detenting of the upper curved portion 30 with camming surface 35. Since the (first) upper curved portion 29 is compressed under the flat track portion 33 of slider 16, the lower curved portions 31, 32 are pressed or biased yeildingly into electrical (bridging) contact with switch contacts 13, 14, respectively.

To turn the switch off, an operating force directed from left to right is applied to the slider 16. With rightward movement of slider 16, upper curved portion 30 contacts camming surface 35 which forces it downward into the unstable (straddling) position (not shown) with consequential full compression of the bridging contactor 15. Continued rightward movement of slider 16 causes the bridging contactor 15 to pass through the unstable position whereupon it rotates in a clockwise manner forcing upper curved portion 29 upward into contact with base 36 of slider 16.

From the above it should be appreciated that the wiping or rubbing action of the lower curved portions 31, 32 on the flat contacts 13, 14, respectively, sweeps off oxide films, and pollutants facilitating electrical contact therebetween. And that the rocking and self-detenting action of the bridging contactor 15 are facilitated by the actions of the free-end portions 40, 41, i.e., the none cantilevered and none affixed ends, of the bridging contactor 15.

Figure 7A:
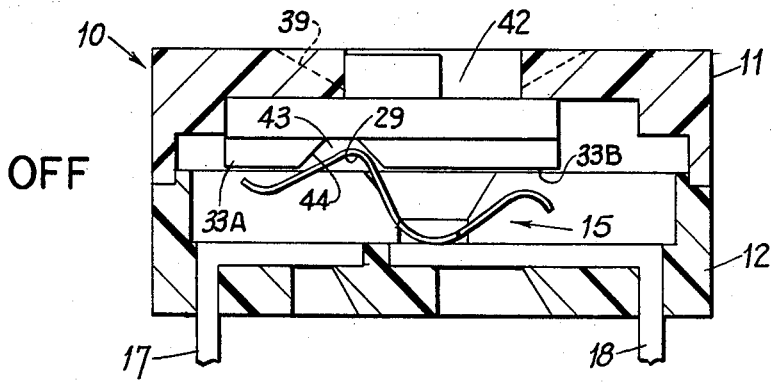
FIGS. 7A and 7B are cross-sectional side views of an alternative embodiment of the invention with the contacts open and closed, respectively.
Figure 7B:
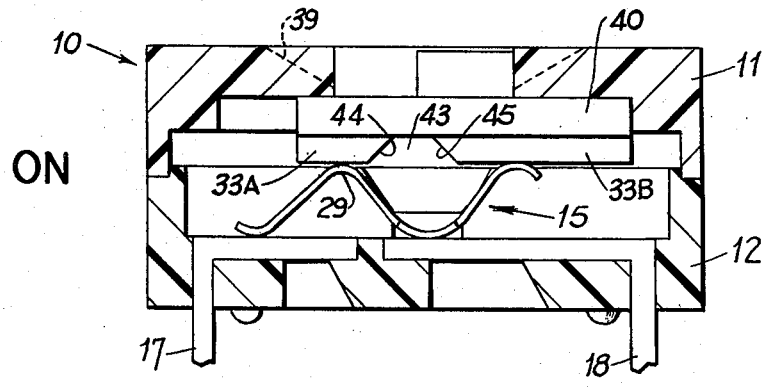

With reference to FIGS. 7A and 7B, an alternative construction of the slide switch is shown. The slide switch assembly shown in these drawings is similar to that shown in FIGS. 1 and 2 with the exception that the slider 42 includes a split slide track 33A, 33B having an intermediate upturned trough or recess 42, with tapered side walls 44, 45. At least one of the tapered side walls, in this embodiment side wall 44, forms a camming surface which coacts with upper curved portion 29 to effect both a detent holding in the switch "off" position (shown in FIG. 7A) and for camming the bridging contactor 15 into the switch "on" position (shown in FIG. 7B) when the slider 42 is subjected to an operating force directed from left to right.

While there has been shown what is considered to be the preferred embodiments of the invention, it is desired to secure in the appended claims all modifications as fall within the true spirit and scope of the invention.

I claim:

1. An electrical switch comprising:

a housing having an interior space and a slot in a portion of the housing;

a pair of spaced stationary contacts each having an exposed contact surface with the interior space of said housing;

a resilient bridging contact means having a free-ended serpentine configuration with a first curved portion held in rocking engagement with one of the contact surfaces and a second curved portion adapted to slidably engage the other contact surface and a third curved portion disposed between said first and second curved portions and a projecting portion extending into said slot; and actuating means having an abutment portion engagable with said third curved portion for selectively urging said bridging contact means between a bridging position and a non-bridging position whereby said bridging contact means undergoes both a rocking and a sliding motion.

2. An electrical switch as in claim 1, wherein:

the first curved portion of said bridging contact means is pivotally surmounted on said one respective contact surface.

3. An electrical switch as in claim 1, wherein:

the interior space of the housing defines a cavity having a slot in each side wall of the housing; and the first curved portion includes two pivot arms each sidewardly projecting into a slot.

4. An electrical switch as in claim 1, wherein:

the housing includes a slot in each side wall of said interior space and an elongated aperture extending into said interior space;

the bridging contact means includes two pivot arm means each projecting into one of said slots for pivotally and slidably affixing the bridging contact means within said interior space of the housing and having a third curved portion; and the actuating means comprises a slide actuator disposed within the housing for movement along a direction joining the stationary contacts, a manually actuatable knob projecting through said elongated aperture for longitudinally disposing the slide actuator whereby a cam track engages said third curved portion for urging the bridging contact means between the bridging position and the non-bridging position.

5. An electrical switch as in claim 1, wherein:

the pair of stationary contacts have their contact-making faces coplanar; and the first curved portion of said bridging contact means is surmounted on one of the coplanar contact-making faces and the second curved portion is aligned with the other coplanar contact-making face of the contacts.

6. An electrical switch as in claim 1, wherein:

the interior space of the housing defines a cavity having a slot in each side wall of said housing;

the bridging contact means is disposed within said cavity and has a first upper and a second upper curved portion each on an opposite side of said first curved portion, said first curved portion includes a pair of rocking arms each projecting into a slot for defining the longitudinal position of the bridging contact means within the cavity while permitting rocking and/or sliding engagement between the first curved portion and a respective contact surface; and the actuating means comprises a manually actuatable slider having a flat slide track with a length approximately equal to the distance between the apex of the first upper and second upper curved portions and a first and a second inclined end portion, the slide track projects into said cavity engaging the first upper and/or second upper curved portions, the slider is movable between the non-bridging position and the bridging position whereby the first and second inclined ends respectively engage the first upper and second upper curved portions to effect detented positioning of the bridging contact means in a selected switch on and off position.

7. A slide switch assembly comprising:

a housing including a base and an interfitting cover defining an interior elongate cavity with a transverse slot in each side wall of the cavity, said cover having an aperture extending into said cavity;

a pair of spaced fixed switch contacts disposed in said cavity in a longitudinal row having their contact-making faces coplanar;

a bridging contact member formed from a spring metal elongate strip being disposed in said cavity and having a sinusoidal configuration longitudinally comprising a first and a second downward projecting bend spaced apart to enable bridging engagement each with a respective contact-making face of said switch contacts and a first and a second upward projecting bend disposed to have said first downward projecting bend lying therebetween, said second downward and second upward projecting bends each have a terminating end-portion which form free-ends of said bridging contact member, said first downward projecting bend has two transverse arm means each being received in one of said slots to enable affixing of the first downward projecting bend in rockable and slidable engagement with one of said contact-making faces of the switch contacts with said second downward projecting bend being engagably aligned with the contact-making face of the other switch contact; and a slide actuator slidably received in said housing having a portion being accessible through the aperture to enable longitudinal movement of the slide actuator, and having camming means projecting into the cavity for engaging at least one of said first and second upward projecting bends with longitudinal movement of said slide actuator whereby the bridging contact member is shifted for causing sliding engagement and non-engagement between said second downward projecting bend and its respective contact-making face of the switch contacts.

8. A slide switch assembly as in claim 7, wherein:

the camming means includes a flat slide track having a length equal to or less than the distance between the peaks of said first and second upward projecting bends and a first and a second inclined end portion each extending between said flat slide track and a ledge of the slide actuator, said ledge being slidably mounted on said base of the slide switch;

whereby with longitudinal movement of said slide actuator from a switch-off to a switch-on position said first inclined end portion firstly engages said first upward projecting bend forcing said second downward projecting bend into sliding engagement with its respective switch contact and secondly engages the flat slide track for maintaining the bridging contact member compressed with said first and second downward projecting bends each being in biased engagement with a respective switch contact, said second upward projecting bend engages said second inclined end portion for detenting the slide switch in the switch-on position and permitting a rocking motion of the bridging contact member over said first downward projecting bend while maintaining engagement with its respective switch contact, and with longitudinal movement of said slide actuator from the switch-on to the switch-off position said second inclined end portion engages said second upward projecting bend camming it into engagement with said flat slide track as said first upward projecting bend engages the first inclined end portion camming the second downward projecting bend out of engagement with its respective switch contact and permitting the bridging contact member to both rock on said first downward projecting bend and detent the slide switch in the switch-off position.

9. A slide switch assembly as in claim 7, wherein:

the camming means includes a split slide track having a first and a second flat slide track portion and a recess with at least one inclined camming surface disposed between said first and second flat slide track portions, the slide track projects into the cavity and slidably engages the bridging contact member, whereby with longitudinal movement of the slide actuator from a switch-off to a switch-on position the inclined camming surface engages the first upward projecting bend forcing the second downward projecting bend into sliding engagement with its respective switch contact and urges the first upward projecting bend under the first flat slide track portion while the second upward projecting bend is compressed under the second flat slide track portion, and with longitudinal movement of the slide actuator from the switch-on to the switch-off position the inclined camming surface cams the first upward projecting bend into said recess while the second upward projecting bend maintains engagement with said second flat slide track portion biasing the bridging contact member to rotate on the first downward projecting bend and causing the second downward project bend to disengage its respective switch contact.

* * * * *